US006387013B1

(12) United States Patent
Marquez

(10) Patent No.: US 6,387,013 B1
(45) Date of Patent: May 14, 2002

(54) EXERCISE ALIGNMENT MAT SYSTEM

(76) Inventor: Jean Pierre Marquez, 3030 N. Santa Ana La., Tucson, AZ (US) 85749

( * ) Notice: Subject to any disclaimer, the term of this patent is extended or adjusted under 35 U.S.C. 154(b) by 0 days.

(21) Appl. No.: 09/518,330

(22) Filed: Mar. 3, 2000

(51) Int. Cl.[7] ..... A63B 26/00
(52) U.S. Cl. ..... 482/23; D6/582; 473/278
(58) Field of Search ..... D21/686, 687, D21/191–199; D6/582, 583, 588, 594; 482/23, 137, 138; 5/465, 12.2, 420, 344; 273/444; 473/266, 270, 278, 414

(56) References Cited

U.S. PATENT DOCUMENTS 5,645,494 A * 7/1997 Dionne et al. ..... 473/278

* cited by examiner

*Primary Examiner*—Michael A. Brown
*Assistant Examiner*—Tam Nguyen

(57) ABSTRACT

An exercise alignment mat system for providing reference to an individual performing an exercise such as yoga. The inventive device includes a mat having a first center line, a second center line orthogonal to the first center line, a plurality of first lines parallel to the first center line, and a plurality of second lines parallel to the second center line. The mat is a flat structure which may be comprised of a resilient and cushioned material. A plurality of markers may be positioned at the intersection of the lines for increased visual references. The student is able to have a visual reference regarding the respective position of their feet, hands and body during an exercise. In an alternative embodiment, the mat includes a first extended portion and a second extended portion on opposite sides of the mat.

12 Claims, 4 Drawing Sheets

EXERCISE ALIGNMENT MAT SYSTEM

BACKGROUND OF THE INVENTION

1. Field of the Invention

The present invention relates generally to exercise mats and more specifically it relates to an exercise alignment mat system for providing reference to an individual performing an exercise such as yoga.

2. Description of the Prior Art

Exercise mats have been in use for years. Typically, a conventional exercise mat is comprised of a flat structure. The conventional exercise mat is typically constructed of a foam rubber material. Most conventional exercise mats have a rectangular shape, however various other shapes are also utilized.

The main problem with conventional exercise mats is that they do not provide a reference point for the individual during exercises. Hence, if an instructor informs a class to rotate their bodies 90 degrees it is often times difficult for the individual to accurately rotate their body.

Examples of patented mat devices include U.S. Pat. No. 4,805,913 to Bott; U.S. U.S. Pat. No. 355,226 to Wadley; U.S. Pat. No. 393,499 to Brown; U.S. Pat. No. 397,269 to Kawamoto; U.S. Pat. No. 291,586 to Bourret which are all illustrative of such prior art.

While these devices may be suitable for the particular purpose to which they address, they are not as suitable for providing reference to an individual performing an exercise such as yoga. Conventional exercise mats do not provide a reference point for the individual exercising leaving the individual to estimate or guess the relative positions of their body during an exercise such as yoga.

In these respects, the exercise alignment mat system according to the present invention substantially departs from the conventional concepts and designs of the prior art, and in so doing provides an apparatus primarily developed for the purpose of providing reference to an individual performing an exercise such as yoga.

SUMMARY OF THE INVENTION

In view of the foregoing disadvantages inherent in the known types of exercise mats now present in the prior art, the present invention provides a new exercise alignment mat system construction wherein the same can be utilized for providing reference to an individual performing an exercise such as yoga.

The general purpose of the present invention, which will be described subsequently in greater detail, is to provide a new exercise alignment mat system that has many of the advantages of the exercise mats mentioned heretofore and many novel features that result in a new exercise alignment mat system which is not anticipated, rendered obvious, suggested, or even implied by any of the prior art exercise mats, either alone or in any combination thereof.

To attain this, the present invention generally comprises a mat having a first center line, a second center line orthogonal to the first center line, a plurality of first lines parallel to the first center line, and a plurality of second lines parallel to the second center line. The mat is a flat structure which may be comprised of a resilient and cushioned material. A plurality of markers may be positioned at the intersection of the lines for increased visual references. The student is able to have a visual reference regarding the respective position of their feet, hands and body during an exercise. In an alternative embodiment, the mat includes a first extended portion and a second extended portion on opposite sides of the mat.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an exercise alignment mat system that will overcome the shortcomings of the prior art devices.

A second object is to provide an exercise alignment mat system for providing reference to an individual performing an exercise such as yoga.

Another object is to provide an exercise alignment mat system that is self-contained within a single structure.

An additional object is to provide an exercise alignment mat system that increases a yoga student's awareness of their relative body positions.

A further object is to provide an exercise alignment mat system that allows a yoga student to correct their body alignment without guessing their position.

Another object is to provide an exercise alignment mat system that makes it easier for a yoga student to follow instructions from an instructor such as "turn your left foot 90 degrees" or "keep your feet parallel to one another".

A further object is to provide an exercise alignment mat system that increases the accuracy of a yoga student's foot placement and body movement.

Another object is to provide an exercise alignment mat system that maintains the placement of feet, hands and body in correct alignment during an exercise.

An additional object is to provide an exercise alignment mat system that makes it easier for a teacher to insure that all of the students are correctly positioned and aligned during an exercise without requiring the instructor to individually correct each individual student.

A further object is to provide an exercise alignment mat system that is a visual tool to practice technique safely and correctly.

Another object is to provide an exercise alignment mat system that can be utilized by teachers and students of various types of exercises.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
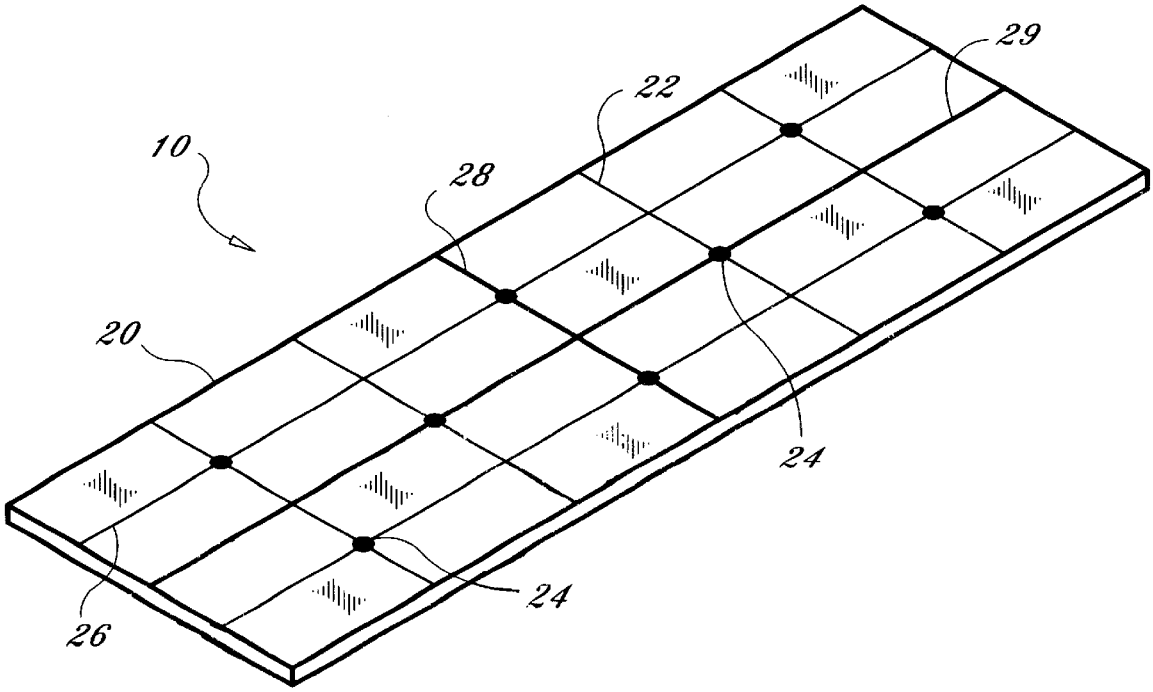
FIG. 1 is an upper perspective view of the present invention.

Turning now descriptively to the drawings, in which similar reference characters denote similar elements throughout the several views, FIGS. 1 through 5 illustrate an exercise alignment mat system 10, which comprises a mat 20 having a first center line 28, a second center line 29 orthogonal to the first center line 28, a plurality of first lines 22 parallel to the first center line 28, and a plurality of second lines 26 parallel to the second center line 29. The mat 20 is a flat structure which may be comprised of a resilient and cushioned material. A plurality of markers 24 may be positioned at the intersection of the lines for increased visual references. The student is able to have a visual reference regarding the respective position of their feet, hands and body during an exercise. In an alternative embodiment, the mat 20 includes a first extended portion 30 and a second extended portion 40 on opposite sides of the mat 20.

Figure 2:
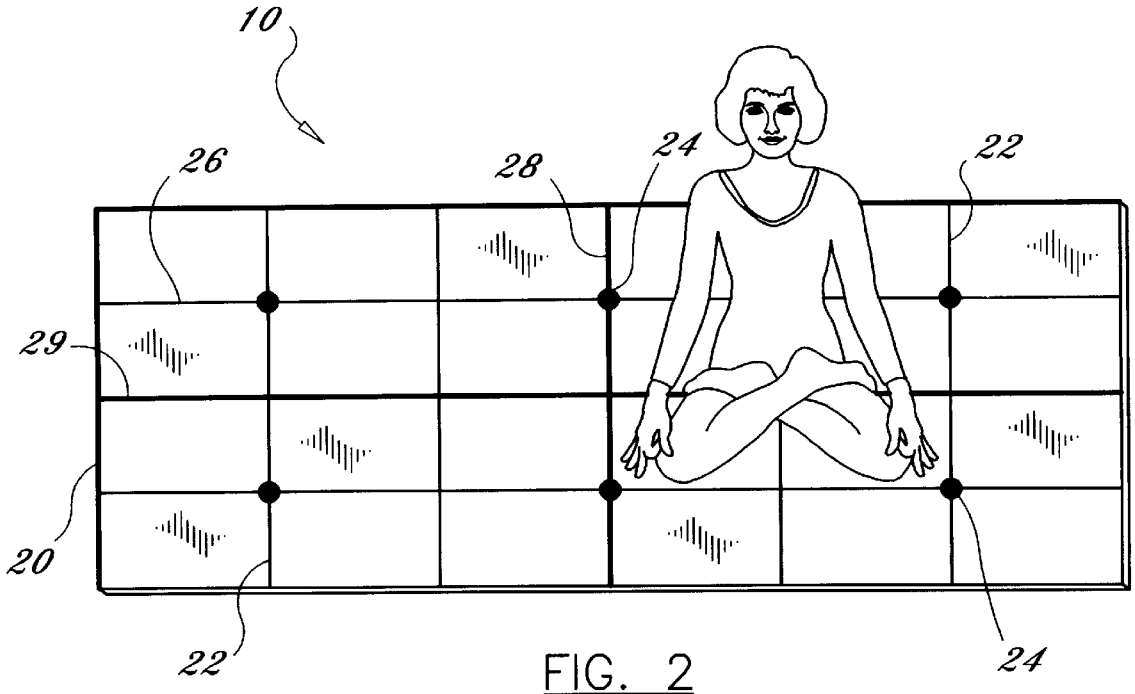
FIG. 2 is a top perspective view of the present invention.
Figure 3:
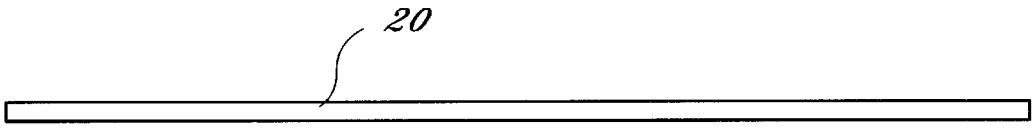
FIG. 3 is a side view of the present invention.
Figure 4:
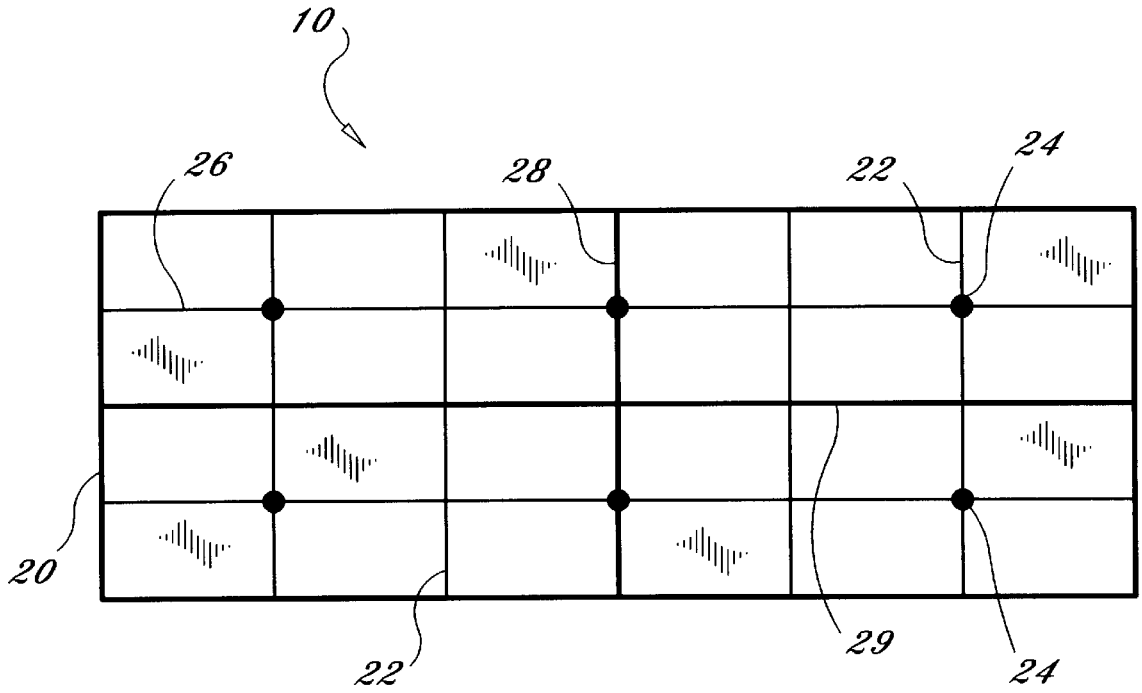
FIG. 4 is a top view of the present invention.

As shown in FIGS. 1, 2 and 4 of the drawings, the mat 20 is a rectangular shaped structure having an elongated portion that includes a longitudinal axis. The mat 20 includes a lower surface and an upper surface. The mat 20 is preferably a flat structure as shown in FIG. 3 of the drawings. The mat 20 may be constructed of any well-known material. The mat 20 may be resilient and flexible or any other physical property.

As shown in FIGS. 1, 2 and 4 of the drawings, a second center line 29 is positioned upon the upper surface of the mat 20. As further shown in the figures, the second center line 29 is aligned along a center line of the mat 20 parallel to the longitudinal axis of the mat 20.

As shown in FIGS. 1, 2 and 4 of the drawings, a first center line 28 is positioned upon the upper surface of the mat 20. The first center line 28 is orthogonal to the second center line 29 and crosses the second center line 29 near a center point of the mat 20 as best shown in FIG. 4 of the drawings. The center lines 28, 29 divide the upper surface of the mat 20 into four quadrants as shown in FIG. 4 of the drawings.

As shown in FIGS. 1, 2 and 4 of the drawings, a plurality of first lines 22 are positioned upon the upper surface of the mat 20. As best shown in FIG. 4, the first lines 22 are parallel to the first center line 28. The first lines 22 are position on both sides of the first center line 28 as further shown in the figures. The first lines 22 cross the second center line 29 as shown in FIG. 4 of the drawings.

As shown in FIGS. 1, 2 and 4 of the drawings, a plurality of second lines 26 are positioned upon the upper surface of the mat 20. As best shown in FIG. 4, the second lines 26 are parallel to the second center line 29. The second lines 26 are position on both sides of the second center line 29 as further shown in the figures. As further shown in FIG. 4 of the drawings, the second lines 26 cross the first center line 28 and the first lines 22 forming a plurality of rectangular shaped boxes. As further shown in FIGS. 1, 2 and 4 of the drawings, the first center line 28 and the second center line 29 are preferably thicker and darker than the first lines 22 and the second lines 26 for increased visual reference for the student.

As shown in FIGS. 1, 2 and 4 of the drawings, a plurality of markers 24 may be positioned at the intersection of the lines 22, 26, 28, 29. The markers 24 may be circular shaped, rectangular shaped, square shaped or any other shape. The markers 24 are preferably comprised of a solid color for providing an increased visual reference.

Figure 5:
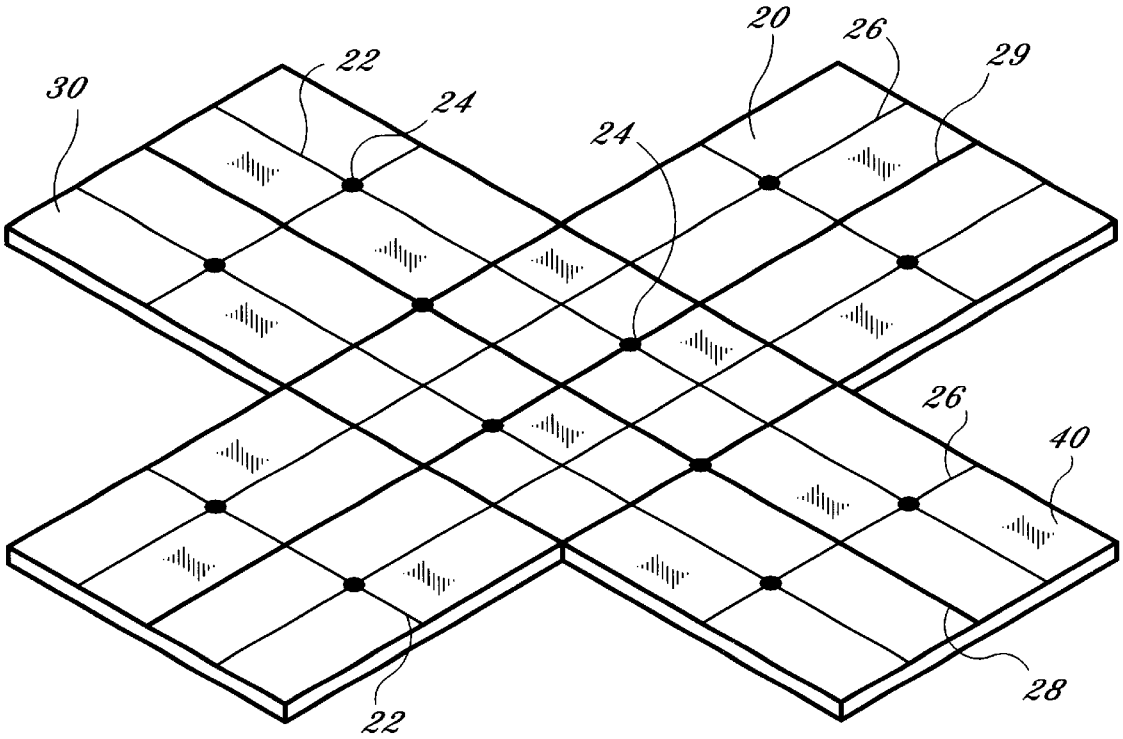
FIG. 5 is an alternative embodiment of the present invention comprised of a cross shape.

In an alternative embodiment shown in FIG. 5 of the drawings, a first extended portion 30 extends from a side of the mat 20 orthogonal to the longitudinal axis of the mat 20. A second extended portion 40 extends from the mat 20 opposite of the first extended portion 30 for providing a cross shaped structure. As shown in FIG. 5 of the drawings, the lines 22, 26, 28 extend upon the upper surface of the extended portions 30, 40.

In use, the student positions their hands and/or feet upon the upper surface of the mat 20. The instructor provides instructions to the student on how to reposition their body. For example, if the student has both of their feet parallel to one another aligned parallel to the first lines 22, if the instructor informs the student to rotate their right foot 90 degrees, the student would reposition their right foot to become parallel to the second lines 26 while maintaining their left foot in parallel alignment with the first lines 22. This process continues until the exercise routine is finished after which the student may roll or fold up the mat 20 into a compact storage structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise alignment mat system, comprising:

a mat comprised of a flat structure having an upper surface, a lower surface and a longitudinal axis;

a first center line positioned upon said upper surface of said mat;

a second center line positioned upon said upper surface of said mat parallel to said longitudinal axis and orthogonal with respect to said first center line, wherein said second center line intersects said first center line;

a plurality of first lines parallel to said first center line;

a plurality of second lines parallel to said second center line;

wherein said first center line, said second center line, said plurality of first lines and said plurality of second lines provide a plurality of rectangles upon said mat, wherein said plurality of rectangles are separated into six non-overlapping sets of four quadrants defining a unit area with three of said sets of four quadrants on each opposing side of said second center line wherein each set of said four quadrants has a center point;

wherein said first center line and said second center line are thicker than said plurality of first lines and said plurality of second lines;

wherein said first center line and said second center line are darker than said plurality of first lines and said plurality of second lines; and a single marker upon selected intersections of said plurality of second lines with said first center line and at each said center point of each set of said four quadrants.

2. The exercise alignment mat system of claim 1, wherein said first center line and said second center line are a different color than said plurality of first lines and said plurality of second lines.

3. The exercise alignment mat system of claim 1, wherein said markers are circular shaped.

4. The exercise alignment mat system of claim 1, wherein said markers are square shaped.

5. An exercise alignment mat system, comprising:

a mat comprise of a flat structure having an upper surface, a lower surface and a longitudinal axis;

said mat further including a first extended portion extending orthogonal with respect to said longitudinal axis, and a second extended portion extending opposite of said first extended portion and orthogonal with respect to said longitudinal axis;

a first center line positioned upon said upper surface of said mat;

a second center line positioned upon said upper surface of said mat parallel to said longitudinal axis and orthogonal with respect to said first center line, wherein said second center line intersects said first center line;

a plurality of first lines parallel to said first center line;

a plurality of second lines parallel to said second center line;

wherein said first center line, said second center line, said plurality of first lines and said plurality of second lines provide a plurality of rectangles upon said mat, wherein said plurality of rectangles are separated into 12 non-overlapping sets of four quadrants defining a unit area with six of said sets of four quadrants on each opposing side of said second center line wherein each set of said four quadrants has a center point;

wherein said first center line and said second center line are thicker than said plurality of first lines and said plurality of second lines;

wherein said first center line and said second center line are darker than said plurality of first lines and said plurality of second lines; and a single marker upon selected intersections of said plurality of second lines with said first center line and at said center point of selected sets of said four quadrants.

6. The exercise alignment mat system of claim 5, wherein said first center line and said second center line are a different color than said plurality of first lines and said plurality of second lines.

7. The exercise alignment mat system of claim 5, wherein said markers are circular shaped.

8. The exercise alignment mat system of claim 5, wherein said markers are square shaped.

9. An exercise alignment mat system, comprising:

a mat comprised of a flat structure having an upper surface, a lower surface and a longitudinal axis;

a first center line positioned upon said upper surface of said mat;

a second center line positioned upon said upper surface of said mat parallel to said longitudinal axis and orthogonal with respect to said first center line, wherein said second center line intersects said first center line;

a plurality of first lines parallel to said first center line;

a plurality of second lines parallel to said second center line;

wherein said first center line, said second center line, said plurality of first lines and said plurality of second lines provide a plurality of rectangles upon said mat, wherein said plurality of rectangles are separated into six non-overlapping sets of four quadrants defining a unit area on opposing sides of said second center line with each set of said four quadrants has a center point; and a single markers upon selected intersections of said plurality of second lines with said first center line and at each said center point of each set of said four quadrants.

10. The exercise alignment mat system of claim 9, wherein said first center line and said second center line are a different color than said plurality of first lines and said plurality of second lines.

11. The exercise alignment mat system of claim 9, wherein said markers are circular shaped.

12. The exercise alignment mat system of claim 9, wherein said markers are square shaped.

* * * * *